United States Patent [19]

Suzuki et al.

[11] 4,343,089

[45] Aug. 10, 1982

[54] OUTER BLADE OF ELECTRIC SHAVERS

[75] Inventors: Tadashi Suzuki, Yuzawa; Sinichiro Tugimura, Nagahama, both of Japan

[73] Assignee: Matsushita Electric Works, Ltd., Osaka, Japan

[21] Appl. No.: 191,755

[22] Filed: Sep. 29, 1980

[30] Foreign Application Priority Data

Oct. 3, 1979 [JP] Japan ..... 54-127756
Oct. 3, 1979 [JP] Japan ..... 54-127757

[51] Int. Cl.[3] ..... B26B 19/02
[52] U.S. Cl. ..... 30/346.51; 30/43
[58] Field of Search ..... 30/346.51, 43, 43.9

[56] References Cited

U.S. PATENT DOCUMENTS 2,292,858 8/1942 Alexay ..... 30/346.51 X
2,300,397 11/1942 Abrams ..... 30/346.51 X
3,742,603 7/1973 Yamaoka ..... 30/346.51
4,138,811 2/1979 Chaury ..... 30/346.51

FOREIGN PATENT DOCUMENTS 54-111964 9/1979 Japan ..... 30/346.51
424528 5/1967 Switzerland ..... 30/346.51

*Primary Examiner*—Jimmy C. Peters
*Attorney, Agent, or Firm*—Burns, Doane, Swecker & Mathis

[57] ABSTRACT

An outer blade for electric shavers having hair inlet apertures the peripheral side wall of respective which is undulated including cove-like retreating parts and head-land-like projecting parts, and the projecting parts are sloped at a smaller angle of inclination than that of the retreating parts for positive raise and introduction specifically of long hair into the apertures.

1 Claim, 17 Drawing Figures

PRIOR ART Fig. 4A
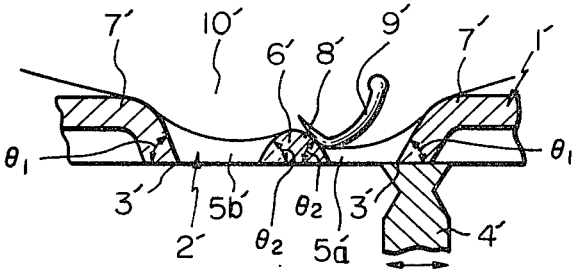
PRIOR ART Fig. 4B
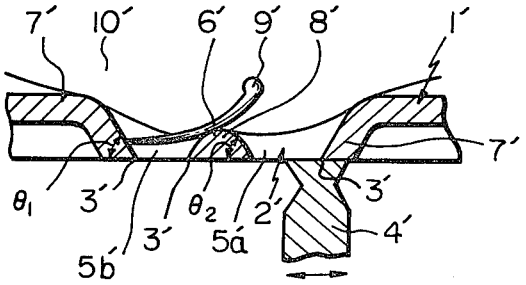
PRIOR ART Fig. 4C
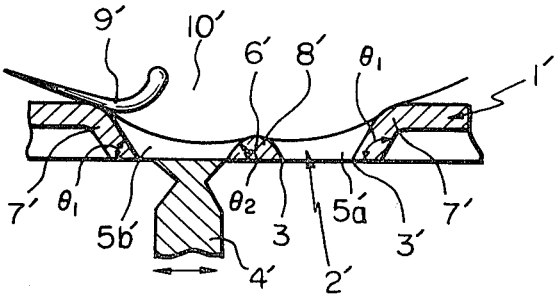

PRIOR ART Fig. 5A
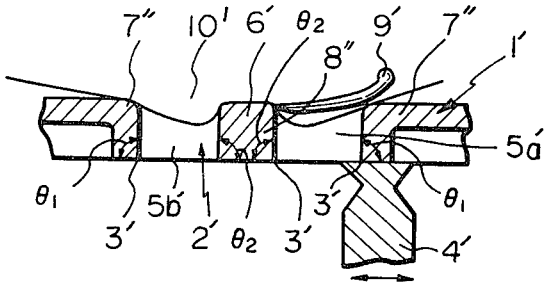
PRIOR ART Fig. 5B
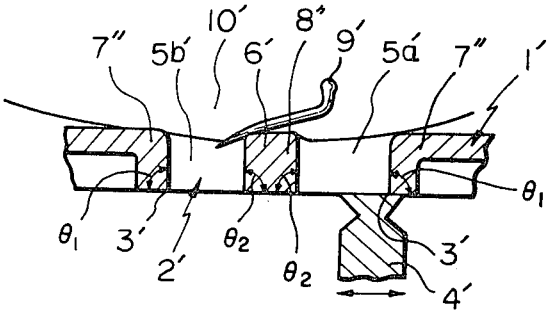
PRIOR ART Fig. 5C
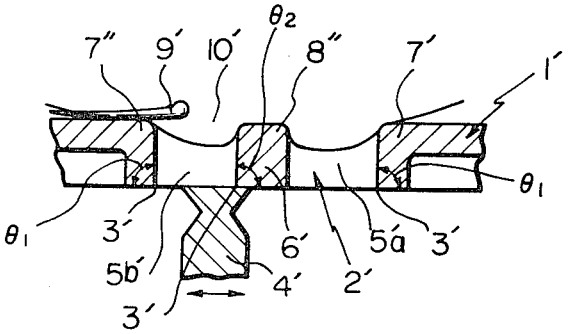

Fig. 12
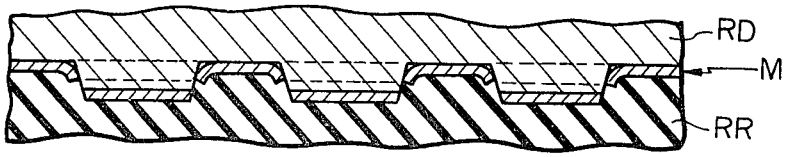
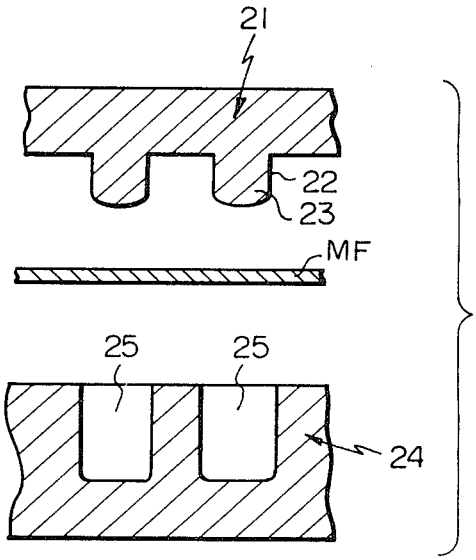
Fig. 13

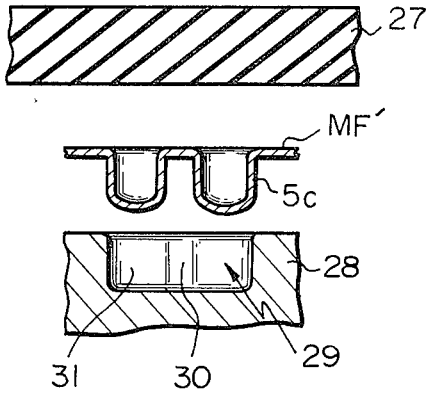
Fig. 17
Fig. 18
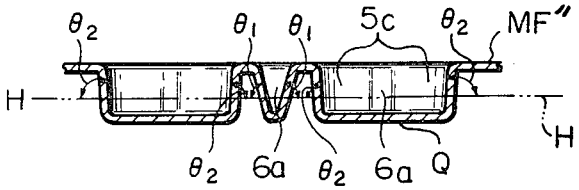
Fig. 19
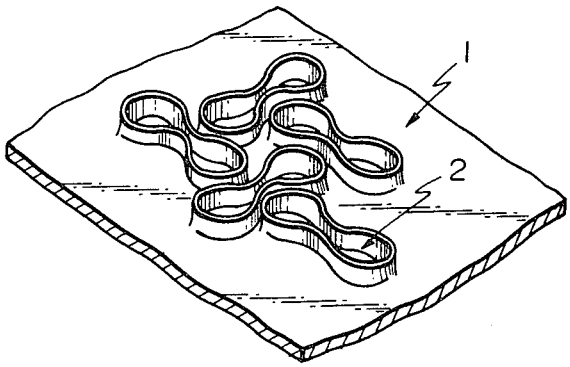

OUTER BLADE OF ELECTRIC SHAVERS

This invention relates to outer blades for electric shavers and, more particularly, to improvements in the outer blade having apertures intended to introduce and cut comparatively long hair.

Generally, in the electric shavers, a shaving blade assembly comprises a stationary outer blade made of a metal foil having many hair inlet apertures the peripheral edges of which on the inner surface side of the foil are made to be hair cutting edges and a movable inner cutter including a plurality of blades having cutting edges which are substantially linear in general as seen in edgewise direction, and the inner cutter is driven to reciprocate or rotate with its cutting edges slidably in contact with the cutting edges of the outer blade so that beard hair introduced through the apertures will be cut with these cutting edges. The hair inlet apertures of various shapes are used and, particularly when it is intended to effectively introduce and cut long hair, such apertures having comparatively higher opening degrees than circular or short slit-shaped apertures of a smaller diameter as a long slit, elliptic, polygonal or the like shape aperture of relatively larger diameters will be used. While the larger diameter apertures of these shapes have an advantages that long hair are easy to introduce, the long hair are not usually erected at the tip from the user's face skin and apt to freely rotate so that, even if the long hair is introduced into the aperture, the hair cannot be cut unless its tip is introduced sufficiently over the cutting edge. Particularly, any irregular hair which is inclined at the root with respect to the skin surface extends long along the face skin without being substantially cut at each shaving, and such hair does not pass over the cutting edge of the outer blade at the tip and is rather often rejected out of the aperture by the inner cutter blade. When all such long hair is introduced into an aperture of the high opening degree, further, it will usually move along a side edge of the aperture to its one ending edge part which is farthest from a specific inner cutter blade passing through the particular aperture and where the hair is to be eventually cut. Therefore, while the long hair moves along the side edge, it is apt to be rejected by the inner cutter blade or to be only partly cut off so as not to be shaven short. Thus, the apertures provided in the conventional outer blade intended to introduce and cut long hair are unable to reliably and effectively attain their expected object. For the hair which rather regularly extends to be short substantially upright from the face skin, such hair is comparatively high in the rigidity and, therefore, the larger diameter apertures can function in the same manner as ordinary apertures of other shapes or smaller diameter.

It is already suggested to solve these problems by making, as typically shown in FIGS. 1 to 3, the cutting edge of the respective apertures 2' of the outer blade 1' to be of an intricate shape having in these cases such various parts retreating and projecting with respect to the sliding direction of the inner cutter blade 4' as, for example, coves 5' and headlands 6' likewise an intricate shoreline or, in other words, to be a twin-circle or bottle-gourd shape which consisting of a pair of circularly swelling parts 5' and contracting parts 6' communicating between the parts 5'. That is, the cutting edge 3' of the aperture 2' is made in an intricate shape having the coves 5' and headlands 6' (which shall be so referred to hereinafter) so that a comparatively long hair 9' will be introduced and guided toward either one of the coves 5' by means of the headland 6' so as to be cut within the cove 5 to thereby solve the problems. In these conventional examples, however, the angles of inclination of side walls 7' and 8' (FIGS. 1 and 2) or 7'' and 8'' (FIG. 3) respectively at the cove 5' and headland 6' with respect to the inner surface of the outer blade, in particular, the cutting edge surface of the apertures are formed to be substantially identical with each other, and this identical angle of inclination has been resulted in such problem that the hair 9' is not well introduced into the apertures 2' and can not be cut to be short. Referring to this more in detail, there are two different cases in the conventional outer blade of the kind referred to, in one of which the entire periphery of the aperture 2' including the side walls 7' and 8' has a comparatively small angle of inclination as in FIGS. 1, 2 and 4A to 4C but thus the angle $\theta_1$ of the side wall 7' at the cove 5' and the angle $\theta_2$ of the side wall 8' at the headland 6' coincide with each other, and in the other of which the side walls 7'' and 8'' have both comparatively a large angle of about 90 degrees as shown in FIGS. 3 and 5A to 5C but thus the angle $\theta_1$ of the side wall 7'' at the cove 5' and the angle $\theta_2$ of the side wall 8'' at the headland 6' also coincide with each other. In the former case, the respective side walls 7' and 8' are inclined to open outward with the smaller angle $\theta_1$ or $\theta_2$ so that the hair 9' contacting the side walls 7' and 8' will slide to escape to the side of the skin 10' so as not be well introduced into the aperture 2' in either of the cove 5' and headland 6' and to be after all left unshaven. That is, as seen in FIG. 4A, the hair 9' about to be introduced into one cove **5*a*' will contact the side wall 8' inclined with the same angle $\theta_2$ of inclination of the headland 6' but, when the shaver is moved at this time to slide the outer blade 1' relatively to the skin 10', the hair 9 will pass over the side wall 8' of the headland 6' to contact the other side wall 7' also inclined with the small angle $\theta_1$ of the cove 5' as seen in FIG. 4B so as to ride on the side wall 7' of the other cove 5*b*' without being introduced even into this cove 5*b*' and, as a result, the hair 9' is not introduced at all into the aperture 2' and cannot be shaven. In the latter case, on the other hand, the headland 6' stands up high and the respective side walls 7'' and 8'' are vertically upright as seen in FIGS. 5A to 5C so that, when the hair 9' is pressed at the base against the upper part of the upright side wall 7'', the hair 9' will be prevented from being raised on the face skin 10' and, also when the outer blade 1' is slid relatively to the skin 10', the hair 9' will move across the both side walls 7'' and 8'' of the cove 5*a*' onto the headland 6' as seen in FIGS. 5A and 5B as being prevented from being introduced into the cove 5*a*'. Thus, on the side of the skin 10' of this headland 6', the same problem as has been referred to above also occurs and, after all, this hair 9' will not be introduced also into the other cove 5*b*' but will be moved over the surface of the outer blade 1' without being cut at all as seen in FIG. 5C. The side walls 7'' and 8'' are also defective in that, since they are upright, the opening area on the side of the face skin 10' of the aperture 2' specifically adjacent the headland 6' is small as compared with the former case so that the amount of swelling entry of the skin 10' into the aperture 2' will be made smaller and the hair 9' will be prevented from being raised, and that the opening area through which the hair 9' is introduced into the aperture 2' is small so that the efficiency of the introduction of the hair 9'** into the aperture will be low and, if the amount of projection of the headland 6′ is reduced to enlarge this opening area, expected undulation between the cove 5′ and the headland 6′ will become so small that expected shifting of the hair introduced into the aperture 2′ smoothly from the headland 6′ to the cove 5′ is thereby deteriorated and thus the introduced hair cannot be positively held.

The present invention has been suggested in consideration of these problems of such hair inlet apertures having in particular the high opening degree and intricate shape in the conventional outer blades as has been described above.

A primary object of the present invention is, therefore, to provide an outer blade for electric shavers provided with hair inlet apertures which can positively catch, introduce and cut to be short not only beard hair upright from the face skin and easy to catch but also any hair growing comparatively long along the face skin and so on and hard to catch.

Another related object of the present invention is to provide an outer blade for electric shavers provided with hair inlet apertures which are high particularly in raising and introducing beard hair extending along the face skin.

Still further related object of the present invention is to provide an outer blade for electric shavers provided with hair inlet apertures which have undulated peripheral walls of respectively optimumly different angles of inclination relative to the outer blade's cutting edge surface of the respective peripheral wall parts which are retreating and projecting with respect to the approaching inner cutter blade so as to be able to cut the beard hair in all states at a high efficiency.

Other objects and advantages of the present invention shall be made clear as the following explanation of the invention advances as detailed with reference to preferred embodiments illustrated in accompanying drawings, in which:

FIGS. 4A to 4C are explanatory views for the operation of the outer blade in cross-section on line B—B in FIG. 1;

FIGS. 5A to 5C are explanatory views in cross-section on line C—C in FIG. 3 of the outer blade;

Figure 1:
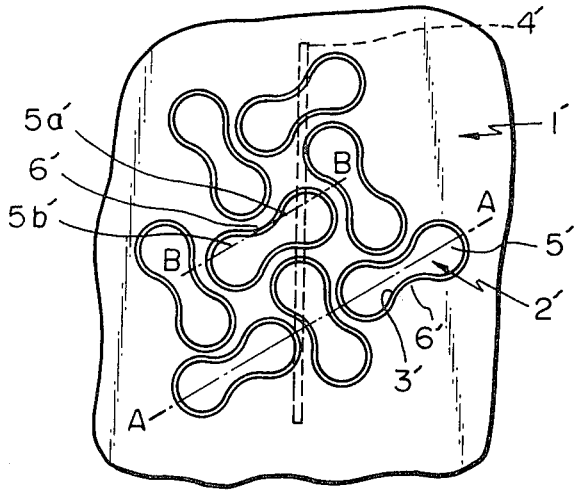
PRIOR ART Fig. 1
FIG. 1 is a fragmentary plan view as magnified of an example of a conventional outer blade of electric shaver.
Figure 2:
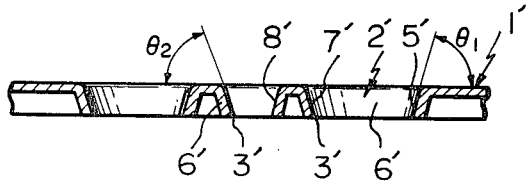
PRIOR ART Fig. 2
FIG. 2 is a sectioned view of the outer blade on line A—A in FIG. 1.
Figure 3:
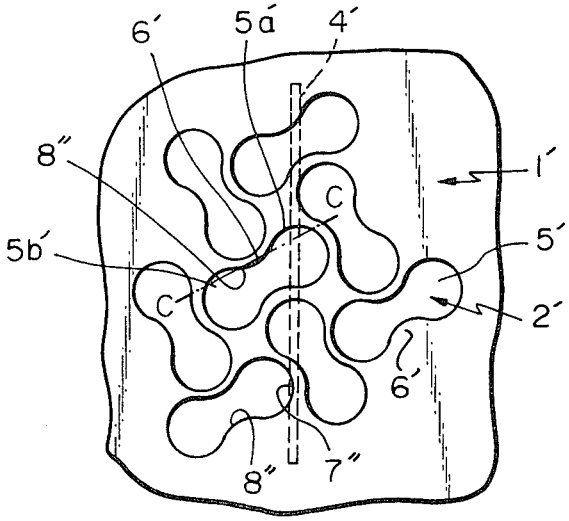
PRIOR ART Fig. 3
FIG. 3 is a fragmentary plan view as magnified of another example of conventional outer blade.

While the present invention shall be detailed in the following with reference to the preferred embodiments as shown in the drawings, the intention is not to limit the invention to the particular embodiments but is to rather include all alterations, modifications and equivalent arrangements possible within the scope of appended claims.

Figure 6:
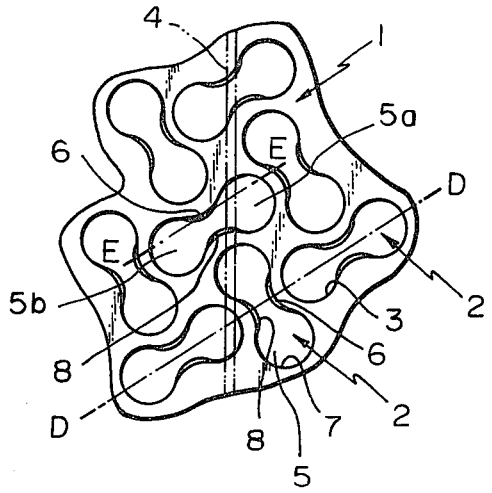
FIG. 6 is a fragmentary plan view as magnified of an outer blade in an embodiment of the present invention.
Figure 7:
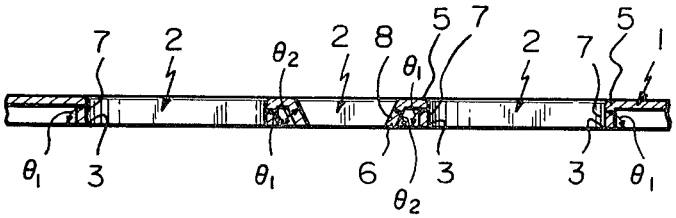
FIG. 7 is a sectioned view of the outer blade of FIG. 6 taken on line D—D.

Referring now to the embodiment of the present invention shown in FIGS. 6 to 8, the outer blade 1 according to this embodiment is featured in that, in respective hair inlet apertures 2 each having a cutting edge 3 of the same shape as in the before described conventional example, the angle $\theta_1$ of inclination of side wall 7 of a pair of concave portions or coves 5 is made larger than the angle $\theta_2$ of inclination of side wall 8 of a pair of convex portions or headlands 6 between the respective coves 5. In this embodiment, generally, short and upright growing beard hair can be cut off by any part of the edge 3 but long hair 9 is to be cut off mostly by the coves 5 which are recessed with respect to the reciprocally or rotary sliding direction of respective movable inner cutter blades 4 substantially in the same manner as in the case of the before described conventional examples. Thus, for the long hair 9, the headlands 6 formed adjacent these coves 5 are substantially not contributive to the shearing of the long hair 9 but are contributive to a shifting of the introduced hair 9 into either of the pair of coves 5 where the long hair is to be cut off. At this time, the angle $\theta_1$ of inclination of the side wall 7 of the respective coves 5 is made larger than the angle $\theta_2$ of inclination of the side wall 8 of the respective headlands 6 and either of these angles $\theta_1$ and $\theta_2$ is made to quickly vary to the other, that is, within a short distance of connecting parts between the respective side walls 7 and 8.

Figure 8A:
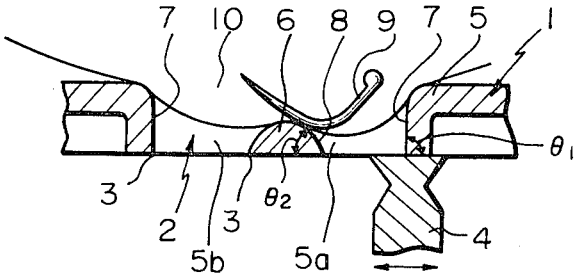
FIGS. 8A to 8C are cross-sectional views taken on line E—E in FIG. 6 for explaining the operation of the outer blade shown in FIG. 6.
Figure 8B:
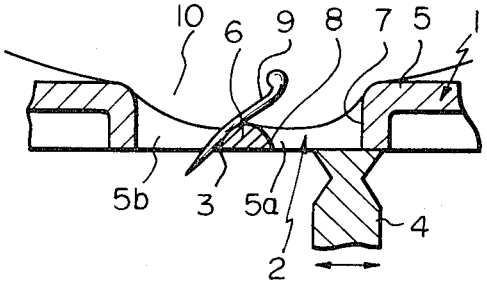
Figure 8C:
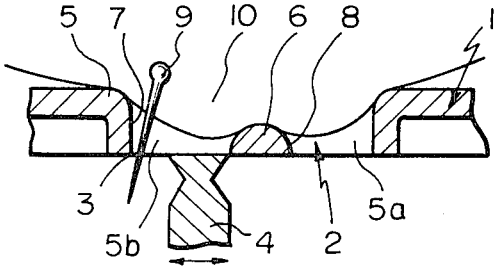

Therefore, the long hair 9 introduced into the aperture 2 along the side wall 8 of the headland 6 will be caused to shift to the cove 5 without being obstructed by the particular side wall 8. During this shifting of the hair 9 to the cove 5, the quick variation between the angles $\theta_1$ and $\theta_2$ causes the hair 9 to be urged to quickly move to the side of the cove 5 and to be positively caught and cut off in the cove 5. Further, as the angle $\theta_2$ of the side wall 8 of the headland 6 is made smaller, as shown in FIG. 8, the height of the headland 6 reduces toward its tip end projecting in the aperture 2, whereby the skin 10 is allowed to come deeper into the aperture 2 from the surface side of the aperture 2 and the hair 9 on the skin 10 will be promoted to be raised and favorably introduced into the aperture 2. Further, the hair 9 about to be introduced into one cove 5*a* but hit the side wall 8 of the headland 6 will smoothly pass over the side wall 8 of this headland 6 due to its small angle $\theta_2$ as seen in FIG. 8A so as to be introduced into the other cove 5 while being gradually raised along the side wall 8 of the small angle $\theta_2$ on the other side of this headland 6 as seen in FIG. 8B, and the hair 9 can eventually be cut off by the cutting edge 3 in the other cove 5*b* as shown in FIG. 8C. Therefore, while the headlands 6 prevent the skin 10 from entering the aperture 2 so much as to be hurt by the inner cutter blade 4, they do not prevent the hair 9 from entering the cove 5 nor from being raised and introduced into the aperture, but rather cause the hair 9 effectively introduced and held in the cove 5 to be favorably cut off therein by the blade 4. In this embodiment, the respective apertures 2 are provided to be adjacent each other so that the respective coves 5 of one of the apertures will be in the closest relation to each of the headlands 6 of other adjacent ones of the apertures to elevate the opening degree of the entire apertures 2 in the outer blade.

Figure 9:
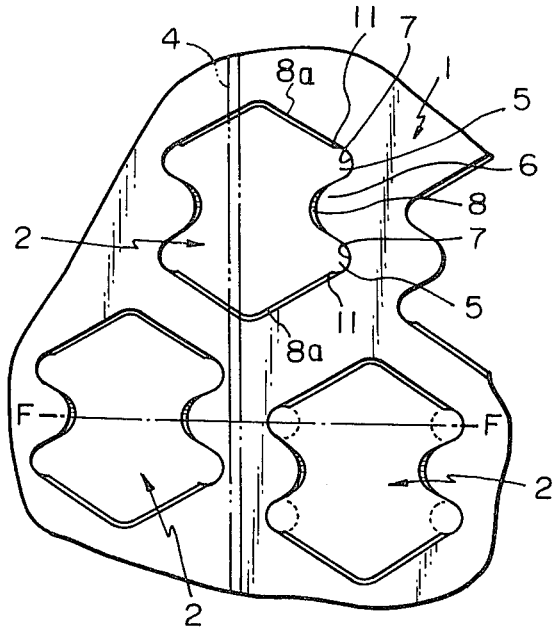
FIG. 9 is a fragmentary plan view as magnified of an outer blade of another embodiment of the present invention.
Figure 10:
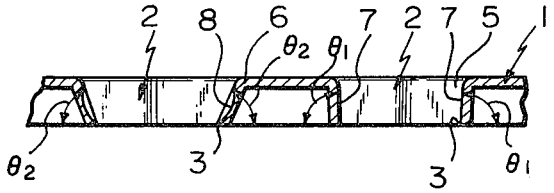
FIG. 10 is a sectioned view taken on line F—F of the outer blade shown in FIG. 9, specifically for showing another embodiment relative to cross-sectional shape of side wall at headland part of the hair inlet aperture.

In FIGS. 9 and 10 showing another embodiment of the present invention in which the shape of the aperture 2 is different, the aperture 2 has two pairs of opposed coves 5 and a pair of opposed headlands 6 but the angles $\theta_1$ and $\theta_2$ of both side walls 7 and 8 are made different from each other as in the case of the foregoing embodiment. The side wall 8 of the headland 6 may be linear in section as in the case of FIG. 7 but, in the present case, its surface is recessed to be a curved surface as shown in FIG. 10. Further, in this embodiment, not only the same improvement in the hair cutting efficiency as in the foregoing embodiment is obtained but also, as the surface of the side wall 8 is recessed to be curved, the hair 9 introduced into the aperture 2 at the headland 6 can be favourably shifted to the cove 5 while being prevented from being incompletely cut at this headland 6 and can be completely cut off in the cove 5.

In the apertures 2 of this embodiment, further, side walls 8*a* expanding in the longitudinal direction of the inner cutter blade 4 from the coves 5 of the respective pairs opposed to each other are separate from each other in the longitudinal direction, but it cannot except that these most separated parts of the expanded side walls 8*a* will have the same function of the cove 5 with respect to the long hair, and these side walls 8*a* are made to be of the same small angle $\theta_2$ of inclination as of the side walls 8 of the headlands 6. Here, at least one of the mutually separating side walls 8*a* can be projected contrarily toward the center of the aperture, in which such case, too, the side wall 8*a* should be made to be of the small angle $\theta_2$. In either case, respective connecting parts 11 between the small-angled side walls 8 and the large-angled side walls 7 are made to be the parts where the angle of inclination varies quickly from one to the other within a short distance, so as to be high in the effect of shifting and introducing the long hair 9 into the cove 5.

Figure 11:
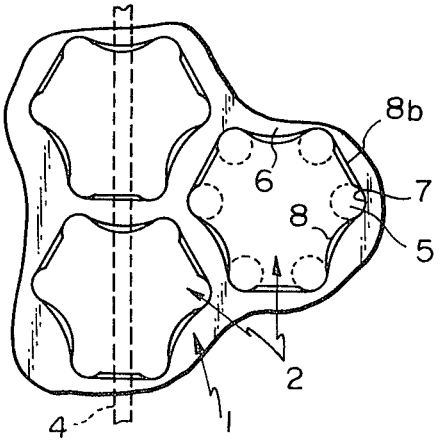
FIG. 11 is a fragmentary plan view as magnified of an outer blade of still another embodiment of the present invention.
Figure 14:
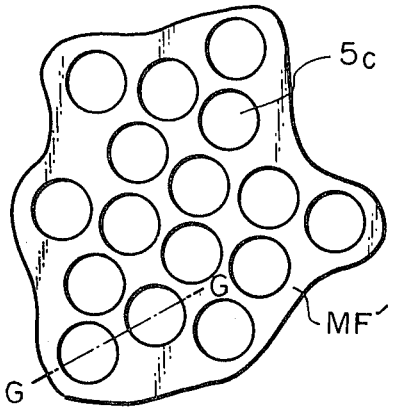
Figure 15:
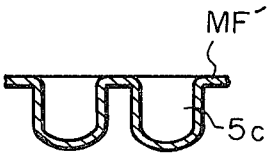
Figure 16:
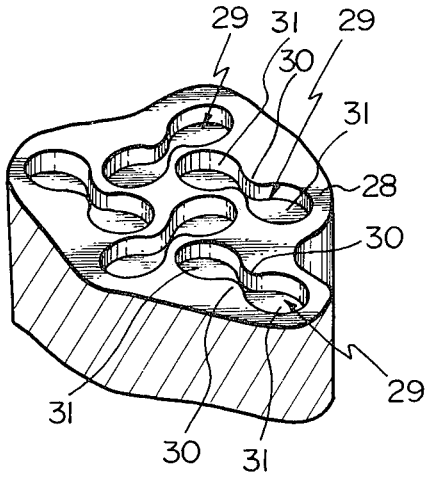

In FIG. 11 showing still another embodiment of the present invention in which the aperture 2 is formed to be substantially hexagonal, each corner part of the hexagonal shape is rounded to be a cove 5, the angle $\theta_1$ of inclination of its side wall 7 is made large and the side walls of other parts between the respective coves 5 have a small angle $\theta_2$ of inclination but are made straight parts 8*b* alternately with the projecting side walls 8 of the headlands 6 in this case. All of these side walls 8 and 8*b* between the respective coves 5 may of course be formed to be the headlands 6 or can be all made straight but, in either case, the side walls 8 and 8*b* should be inclined at the small angle $\theta_2$.

According to the present invention, as has been described, the outer blade according to the present invention is formed to have the larger angle of inclination at the side walls of the coves while the smaller angle of inclination is given to the headlands in the respective hair inlet apertures, so that even the long hair lying along the user's face skin can be raised by the side walls of the smaller angle of inclination at the headlands and can be introduced smoothly into the aperture as caused to hit the side wall surface having the large angle of inclination at the coves, without advancing over the upper surface of the aperture due to the relative movement to the face skin of the outer blade as in the conventional blades in which the entire peripheral side wall of the aperture has a large angle of inclination, and also without being rejected out of the aperture as caused to hit the side wall of a small angle of inclination as in the other type conventional blades in which the entire peripheral side wall of the aperture has the small angle of inclination, and the long hair can be well cut without being left unshaved. Further, as the side walls of the headlands are of a small angle of inclination, the opening on the skin surface side of the aperture will be relatively large in such side wall parts and hair can be smoothly introduced into the aperture whereas, on the cutting edge side, the opening of the aperture will be relatively small so that the radius of curvature of the curve connecting from the partial cutting edge of this side wall part of the headland to the other partial cutting edge of the cove will be small and the introduced hair will be well held in the cove to be effectively cut to be short. Further, when the side wall of the headland is formed to be recessed to have a curved surface as in one of the embodiments, the hair will be better introduced into the cove and, as the angles of inclination of both side walls of the headland and cove are quickly varied in their connecting part, the hair can be quickly introduced and held in the cove and will be prevented from escaping therefrom once introduced into the cove.

What we claim as our invention is:

1. An outer blade for electric shavers made of a metal foil and comprising an outer surface which slides against the user's skin and an inner surface against which an inner blade may slide, said outer blade including hair inlet apertures each having an undulated peripheral sidewall, said sidewall including a plurality of portions oriented generally concave relative to the center of said aperture as viewed in a direction perpendicular to the plane of said outer blade, and a plurality of portions oriented relatively convex relative to said center as viewed in said direction, each said sidewall portion having an angle of inclination comprising the angle which the respective sidewall portion makes with said inner surface, the angle of inclination of said generally concave portions being larger than that of said generally convex portions, said sidewall portions arranged such that said apertures are larger at said outer surface than at said inner surface.

* * * * *